US008634586B2

(12) United States Patent
Smith et al.

(10) Patent No.: US 8,634,586 B2
(45) Date of Patent: Jan. 21, 2014

(54) CEILING-MOUNTED LOUDSPEAKER ENCLOSURE

(75) Inventors: Lowell J. Smith, Palos Verdes, CA (US); Stuart W. Lumsden, Baltimore, MD (US); Scott Orth, Baltimore, MD (US)

(73) Assignee: Polk Audio, Inc., Baltimore, MD (US)

( * ) Notice: Subject to any disclaimer, the term of this patent is extended or adjusted under 35 U.S.C. 154(b) by 488 days.

(21) Appl. No.: 12/823,852

(22) Filed: Jun. 25, 2010

(65) Prior Publication Data

US 2011/0019862 A1 Jan. 27, 2011

Related U.S. Application Data

(60) Provisional application No. 61/220,917, filed on Jun. 26, 2009.

(51) Int. Cl.

| | |
|---|---|
| ***H04R 1/02*** | (2006.01) |
| ***H04R 9/06*** | (2006.01) |
| ***A47B 81/06*** | (2006.01) |

(52) U.S. Cl.

USPC ..... 381/386; 381/89; 381/160; 381/182; 381/335; 181/199

(58) Field of Classification Search

USPC ..... 381/386, 160, 182, 89; 181/199

See application file for complete search history.

(56) References Cited

U.S. PATENT DOCUMENTS

| | | | | | |
|---|---|---|---|---|---|
| 2,979,149 | A * | 4/1961 | Carlsson | 181/147 |
| 3,540,544 | A * | 11/1970 | Karlson | 181/154 |
| 4,122,911 | A * | 10/1978 | Croup | 181/199 |
| 4,348,549 | A * | 9/1982 | Berlant | 381/99 |
| 4,451,928 | A * | 5/1984 | Murayama | 381/86 |
| 4,580,654 | A * | 4/1986 | Hale | 181/146 |
| 5,025,473 | A * | 6/1991 | Carlsen et al. | 381/387 |
| 5,088,574 | A * | 2/1992 | Kertesz, III | 181/150 |
| 5,450,495 | A * | 9/1995 | Goldfarb | 381/89 |
| 5,525,767 | A * | 6/1996 | Fields | 181/155 |
| 5,561,717 | A * | 10/1996 | Lamm | 381/89 |
| 5,673,329 | A * | 9/1997 | Wiener | 381/160 |
| 5,734,732 | A * | 3/1998 | Lemmon | 381/386 |
| 6,385,324 | B1 * | 5/2002 | Koppen | 381/336 |
| 6,766,027 | B2 * | 7/2004 | Ryan et al. | 381/182 |
| 6,870,943 | B2 * | 3/2005 | Liu | 381/395 |
| 6,996,243 | B2 * | 2/2006 | Welker et al. | 381/160 |
| 7,142,680 | B2 * | 11/2006 | Gelow et al. | 381/182 |
| 7,219,873 | B2 * | 5/2007 | Harwood | 248/519 |
| 8,036,410 | B2 * | 10/2011 | Koren et al. | 381/345 |
| 8,224,014 | B2 * | 7/2012 | Sprinkle | 381/386 |
| 2004/0125974 | A1 * | 7/2004 | Kosatos et al. | 381/335 |
| 2005/0123156 | A1 * | 6/2005 | Wright et al. | 381/182 |
| 2006/0231328 | A1 * | 10/2006 | Moore | 181/199 |
| 2011/0051971 | A1 * | 3/2011 | Nedelcu | 381/354 |

* cited by examiner

*Primary Examiner* — Elvin G Enad
*Assistant Examiner* — Christina Russell
(74) *Attorney, Agent, or Firm* — J.A. McKinney & Assoc., LLC

(57) ABSTRACT

A ceiling-mounted loudspeaker includes a horn-shaped enclosure, an acoustic driver, and a front module. The tubular or horn-shaped enclosure carries a slanted woofer or loudspeaker driver which radiates into an angled or slanted first opening. The tubular enclosure terminates at bottom in a second, circular opening substantially parallel to a second plane, wherein the woofer's slanted plane is inclined with respect to the second plane. The slanted woofer can be oval and radiates sound through the enclosure's interior lumen and outwardly through ports defined in a substantially circular baffle carrying the front module and connected to the second opening. The baffle carries a midrange and tweeter near the ceiling where they can provide enhanced sound dispersion.

7 Claims, 6 Drawing Sheets

FIG. 6
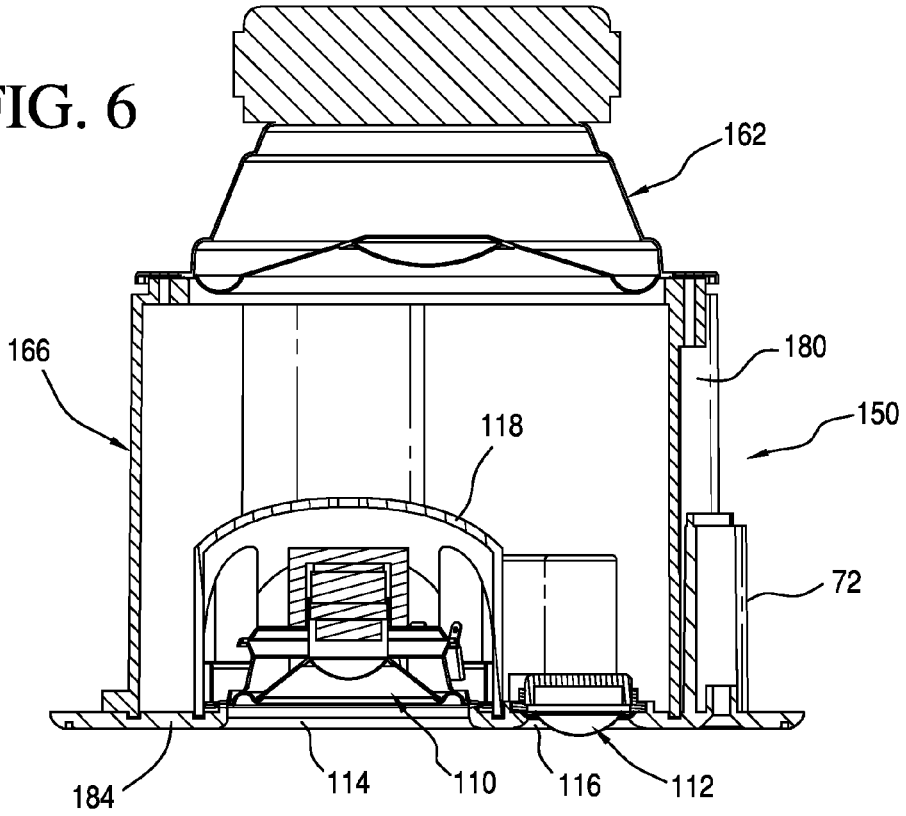
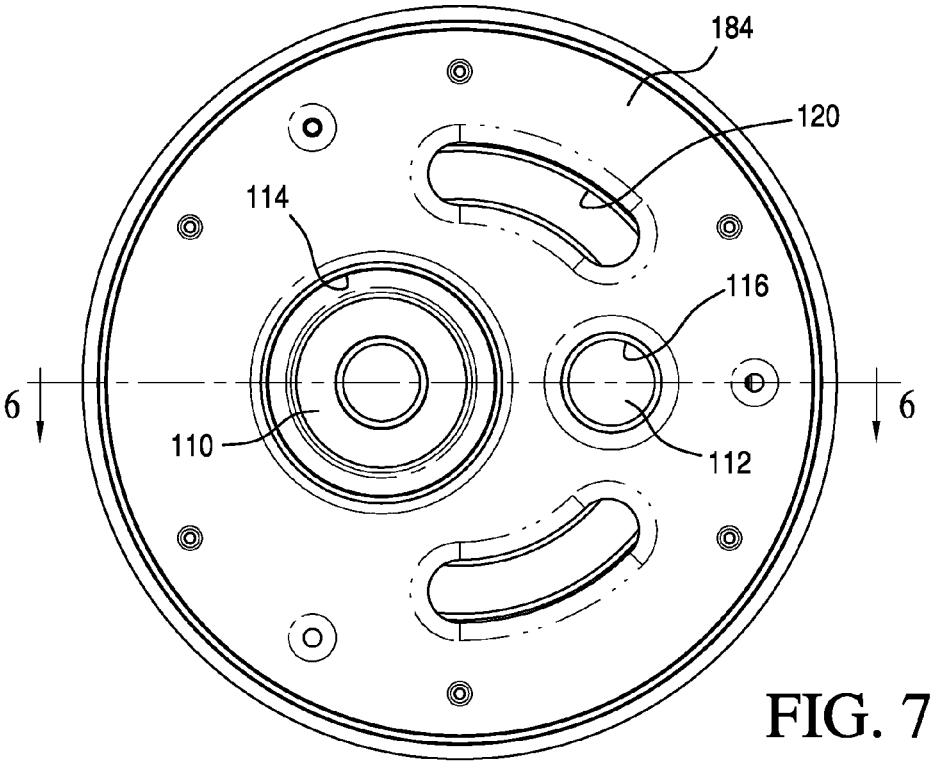
FIG. 7

CEILING-MOUNTED LOUDSPEAKER ENCLOSURE

RELATED APPLICATION INFORMATION AND PRIORITY CLAIM

This application claims priority to and the benefit of U.S. Provisional Patent Application No. 61/220,917, filed 26 Jun. 2009, and entitled "Ceiling Loudspeaker and Enclosure" the entire disclosure of which is incorporated herein by reference.

TECHNICAL FIELD

The present invention relates, in general, to a ceiling loudspeaker and in particular to a ceiling loudspeaker with a horn-shaped enclosure.

BACKGROUND OF THE INVENTION

Ceiling-mounted audio loudspeakers are well known in the art and have been commercially available for many years. Examples of such loudspeakers can be found in U.S. Pat. No. 5,088,574; U.S. Pat. No. 6,870,943; and U.S. Pat. No. 7,142,680, among other places. A ceiling loudspeaker is usually mounted in a hole that is cut in a ceiling structure, such as a ceiling tile, with the speaker being inserted through the hole and mounted to the tile or other plenum structure. The trend in interior design is for ceiling items, such as lighting fixtures, to be made smaller and less obtrusive, and ceiling-mounted loudspeakers are no exception to this. However, making a loudspeaker smaller generally involves a trade off in performance, usually involving the loss of bass frequencies, a reduction in speaker efficiency, or a combination of both, and as the size of the hole on the ceiling is reduced, the installation of an acoustic driver large enough to produce the desired level of output power has become a challenge for ceiling loudspeaker designers.

Another performance trade off in ceiling speakers is that, to keep the size small while retaining optimum frequency output, the system must use a coaxially mounted tweeter in tandem with a mid-bass driver. This presents two problems. The first is that a coaxially mounted tweeter suffers from the lack of a baffle, for if it is mounted on a bridge it is left hanging above the mid-bass driver. Alternatively, it can be mounted on a post, but still without a baffle. In such a structure, sound radiates from the tweeter to the mid-bass driver and then back out, causing frequency response anomalies in the far field. The second problem is that the mid-bass driver becomes "beamy" at the top of its working range; that is, its sound dispersion pattern is narrow so that as a listener moves off-axis from the driver, less upper midrange sound is heard. The tweeter cannot compensate for this because the low end of its range has been compromised by a lack of a proper baffle.

Thus, there is a need for an improved ceiling loudspeaker design which will avoid the foregoing trade-offs and will provide a loudspeaker that will fit in a reduced-diameter ceiling opening yet will provide the performance of a speaker larger than its apparent size.

BRIEF DESCRIPTION OF THE INVENTION

In accordance with the present invention, a ceiling-mounted loudspeaker includes a horn-shaped enclosure, an acoustic driver, and a front module. The tubular or horn-shaped enclosure carries a slanted woofer or loudspeaker driver which radiates into an angled or slanted first opening. The tubular enclosure terminates at bottom in a second, circular opening substantially parallel to a second plane, wherein the woofer's slanted plane is inclined with respect to the second plane. The slanted woofer can be oval and radiates sound through the enclosure's interior lumen and outwardly through ports defined in a substantially circular baffle carrying the front module and connected to the second opening. The baffle carries a midrange and tweeter near the ceiling where they can provide enhanced sound dispersion.

More generally, the improved in-ceiling loudspeaker assembly of the present invention incorporates a first audio driver, or speaker, which preferably is a low-frequency-range speaker, or "woofer," that is mounted on a top end of a hollow, generally tubular enclosure which serves as a horn-shaped acoustic waveguide for the low-range speaker. This woofer preferably is elongated, with a generally oval face having major and minor axes perpendicular to each other. The speaker assembly also incorporates a speaker module mounted at a bottom end of the tubular enclosure, this module incorporating a face plate, or baffle, having ports for the woofer and, in addition, carrying a mid-frequency-range audio driver, or midrange speaker, and a high-frequency-range audio driver, or tweeter.

In a preferred form of the invention, the tubular enclosure may be somewhat tapered downwardly and outwardly from top to bottom to have a "bent" configuration when viewed from the side. The enclosure has a longitudinal axis and at its bottom has a is circular cross-section in a first plane that is perpendicular to the axis. The top end of the tube is truncated; i.e., is cut off at an angle to its axis to provide a slanted top opening, so that a second plane passing through the rim of the top opening lies at an angle with respect to the first plane. As a result, the top opening of the tubular enclosure is oval in shape having major and minor axes which are selected to match the axes of an oval woofer that is to be mounted on the enclosure. Accordingly, the oval loudspeaker will be slanted with respect to the longitudinal axis of the tubular enclosure and with respect to the bottom opening of the enclosure. The oval speaker has a greater radiating area than would a circular speaker having the diameter of the tubular enclosure, yet by mounting the oval speaker at an angle it fits within the diameter of the bottom opening of the enclosure and projects the same or smaller area, or "footprint," onto the first plane as does the tubular enclosure so that the oval speaker, and the entire speaker assembly, will fit through a circular ceiling opening. The speaker module on the lower end of the tubular enclosure is also circular, has an area that fits within the ceiling opening, and includes mounts for securing the speaker assembly in the circular ceiling opening.

The foregoing slanted mounting configuration provides a speaker assembly having a circular cross-section but an oval speaker that has an enhanced radiating area yet will fit through a smaller hole than would be possible with a circular speaker of similar radiating area. It has been found that the in-ceiling loudspeaker assembly of the present invention provides the bass performance of a standard speaker that is one size larger than would be expected from a loudspeaker having the circular diameter of the enclosure; for example, it will provide the bass frequency output of a standard 6.5" system in a 5.25" ceiling hole.

In accordance with another aspect of the present invention, the in-ceiling speaker assembly of the present invention also overcomes the problems of coaxially-mounted midrange and high-range speakers in a small speaker system. As described above, the low frequency driver (woofer) unit is located in the rear of the system, or at the top of the tubular enclosure, and the speaker module with its midrange and tweeter is located at the bottom end of the enclosure, in front of the woofer. The speaker module includes a face plate that incorporates ports transmitting the sound from the woofer into a listening space in front of the speaker assembly; i.e., below the ceiling, but in accordance with the invention this face plate also serves as a baffle plate for mounting tweeter and midrange drivers within the enclosure. Since the ports take up only a portion of the surface of the baffle, the tweeter and midrange driver outputs suffer much less from the diffraction and reflection than occurs in a comparable two-way, in-ceiling speaker system. The dispersion in the midrange and high frequencies are much better as a result.

In another embodiment of the invention, the tubular enclosure may be generally cylindrical, with the above-described speaker module mounted at its lower end to provide the advantages of a midrange driver and a baffled tweeter in a ceiling speaker assembly. In this case, however, the top-mounted woofer may be a circular speaker mounted on the top rim of the enclosure in a plane parallel to the plane of the bottom opening of the enclosure.

The present application thus provides a ceiling-mountable loudspeaker assembly including a generally tubular horn enclosure, an acoustic driver at its top end, and a speaker module incorporating a baffle plate at its bottom end. In a preferred form of the invention, the horn enclosure is generally tapered and includes a top opening having its circumferential rim slanted with respect to the longitudinal axis of the enclosure and substantially parallel to a first plane, and a bottom opening having its circumferential rim substantially parallel to a second plane that is perpendicular to the axis of the enclosure, with the first plane being at an angle with respect to the second plane. A first acoustic driver serving as a woofer is mounted to the first opening and outputs sound through the horn enclosure to the second opening. A front module incorporating a baffle plate on which are mounted midrange and tweeter drivers and including ports for the woofer is secured to the second opening of the enclosure for sound dispersion, with the entire assembly having a generally circular footprint so that it can be mounted through a circular opening in a ceiling tile or similar structure with the front baffle plate substantially flush with the ceiling surface.

BRIEF DESCRIPTION OF DRAWINGS

The application can be more fully understood by reading the following detailed description and examples of the present invention, with references made to the accompanying drawings, wherein:

FIG. 6 is a cross-sectional view of the assembled speaker assembly of FIG. 5; and FIG. 7 is a bottom plan view of the ported baffle plate for the speaker module of the assembly of both FIGS. 1 and 5.

DETAILED DESCRIPTION

Figure 1:
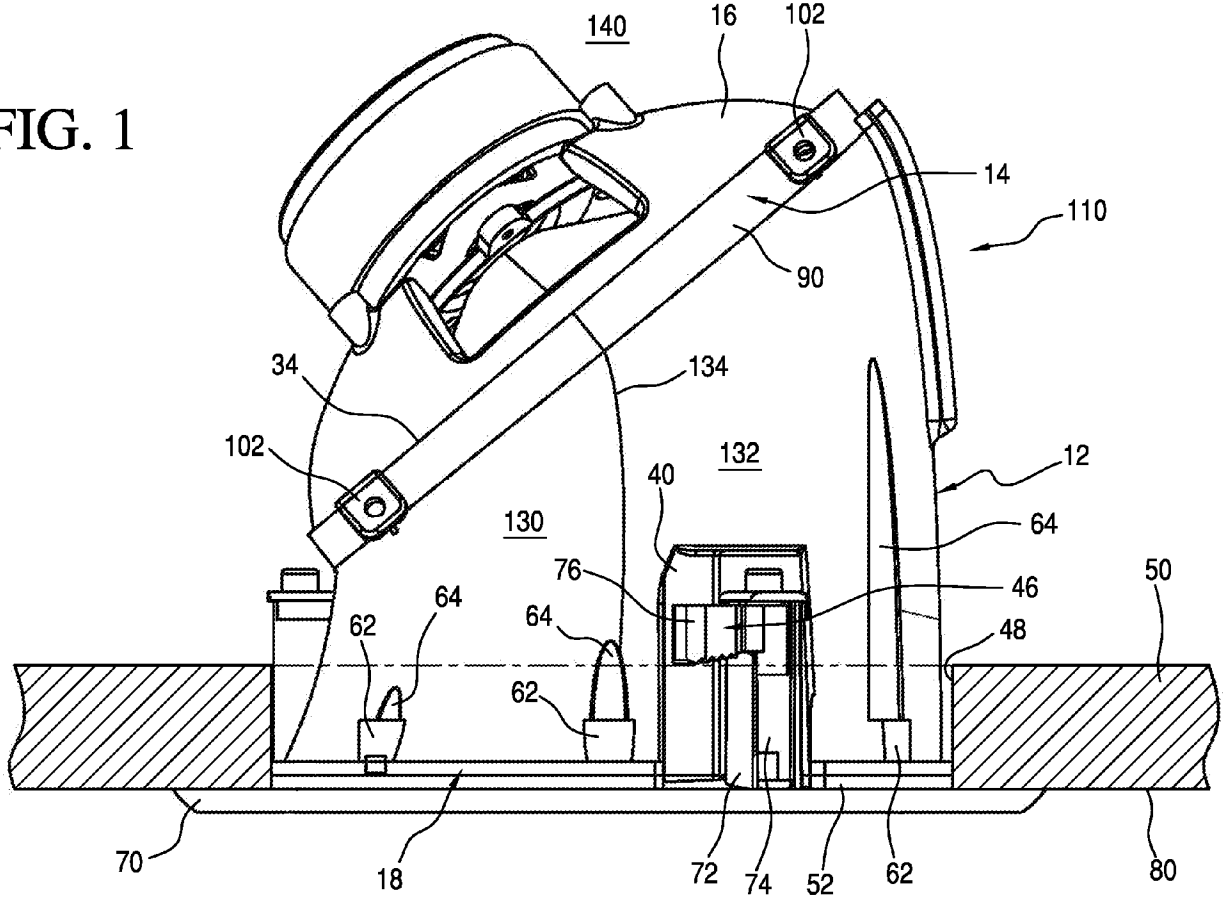
FIG. 1 is a right side view of a ceiling loudspeaker assembly according to an embodiment of the invention, illustrating a generally tubular horn enclosure on top of which is mounted a slanted loudspeaker.

Referring now to the embodiment of the invention illustrated in FIGS. 1 to 4, a ceiling loudspeaker assembly generally indicated at 10 comprises a horn-shaped enclosure 12 supporting at its upper end 14 an acoustic driver 16 and at its bottom end 18 a speaker module 20. Hollow, generally tubular enclosure 12 serves as a horn-shaped acoustic waveguide for the low-range speaker or acoustic driver 16, which may be a woofer driver, for example, and may be suitably driven to generate an acoustic sound which travels through the hollow enclosure's interior lumen or waveguide and through the speaker module 20, which then facilitates sound dispersion outwardly, or when mounted in a ceiling, downwardly, as viewed in the Figures.

Figure 4:
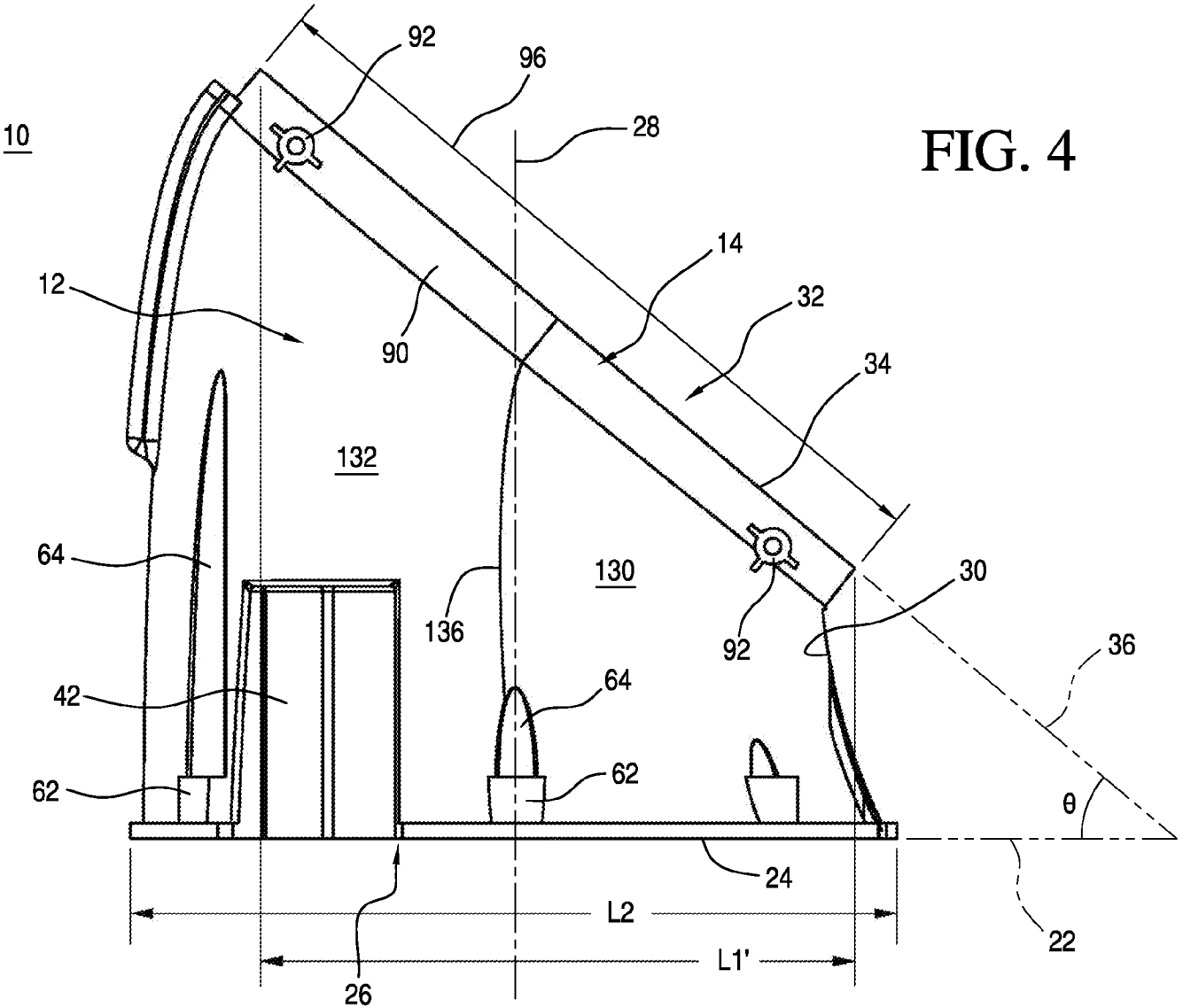
FIG. 4 is a left side view of the horn enclosure of FIG. 1.

As illustrated, the horn enclosure 12 is generally tubular; that is, it has a substantially circular cross-section in a plane, such as the lower or proximal plane 22 defined by the circumference of the rim 24 of the bottom opening 26 (FIG. 2) at the bottom end 18 of the horn enclosure. This plane is perpendicular to the longitudinal axis 28 of the is enclosure, as indicated in FIG. 4. The enclosure 12 may be tapered inwardly and upwardly, as illustrated by the side wall 30 of the enclosure, to a top opening 32 (FIG. 3) having a circumferential rim 34 at the upper end 14. The enclosure is truncated so that rim 34 at its upper end 14 lies in a plane 36 that is at an angle θ with respect to plane 22, whereby the rim 34 of the opening 32 at upper end 14 is slanted with respect to the bottom rim 24, and is oval in shape.

Spaced around the circumference of the lower end of the enclosure 12 are a plurality of recesses, for example three recesses 40, 42 and 44, which receive suitable L-shaped rotatable fasteners 46 that are mounted on the speaker module 20 for securing the speaker assembly 10 in an aperture 48 through a ceiling structure or plenum barrier 50, as will be described in further detail below.

The rim 24 at the bottom end of the enclosure is a transversely projecting or outwardly-extending flange which engages the top surface of a face plate, or baffle plate 52 of the speaker module 20, and to which the enclosure is secured by fasteners such as bolts passing upwardly through upwardly extending bosses 54 on the top surface of the baffle plate. The bosses engage corresponding apertures 60 in the rim 24 to position the enclosure on the speaker module and the fasteners (not shown) pass upwardly through corresponding shoulders 62 spaced around the circumference of the enclosure 12. Recesses 64 above the shoulders 62 are provided to receive the free ends of the fasteners, and to receive corresponding nuts to secure them. Other suitable fasteners may be used, as desired.

The speaker module 20 includes a trim ring 66 having an upstanding body portion 68 and a trim flange 70 to receive the baffle plate 52. The baffle plate rests on an inwardly-extending ledge of the flange 70 within the body portion 68, with the diameter of the body portion 68 being smaller than the diameter of the circular aperture 48 in the ceiling structure to allow the speaker assembly to be mounted in that aperture.

The flange 70 extends outwardly, projecting laterally from the body portion 68 to cover the aperture 48. The trim ring may incorporate a substantially acoustically transparent grill screen of fabric or expanded or perforated metal, which is removed in the Figures for convenience of illustration.

The rotatable fasteners or arms 46 are located on corresponding hollow posts 72 on the face plate 52. These posts extend upwardly into corresponding enclosure recesses 40 when the enclosure is mounted on the face plate. The L-shaped fasteners incorporate downwardly extending slotted pegs 74, which engage and are secured in corresponding posts 72, and outwardly extending arms 76 which are rotated inwardly into their corresponding recesses 40 to allow insertion of the speaker assembly into aperture 48 of a ceiling structure (or plenum defining barrier), and which are rotated outwardly to engage the top of the ceiling structure. Rotation of the fasteners adjusts the speaker module vertically with respect to the ceiling structure, and thereafter the trim ring is pushed over the circumference of the baffle plate so that the flange 70 engages the lower surface 80 of the ceiling structure to secure the assembly 10 in place.

As illustrated in FIG. 1, the bottom edge of each arm 46 may be textured or serrated and tapered to allow clamping force adjustment of the assembly so that there will be firm engagement of the trim ring with the ceiling structure. Access ports through the face plate 52 to the interior of the respective posts 70 allow the fasteners to be rotated by means of the slots in the pegs 72.

Referring to FIG. 4, the woofer mounting angle θ between the plane 22 of the bottom opening 26 of the enclosure and the plane 36 of the top opening 32 is selected to provide an oval-shaped opening 32 which will correspond to the oval shape and size of the acoustic driver ("woofer") 16 that is to be mounted to and carried upon the distal or upper rim 34 of enclosure 12. The enclosure is tapered inwardly and upwardly, as illustrated in the Figures, sufficiently to ensure that the foreshortened lateral projection of any portion of the upper structure attached to the rim 34, when viewed from the bottom plane 22, will be smaller than the diameter of the face plate 52 and of the opening 48 into which the speaker assembly 28 is to be inserted.

For purposes of nomenclature, hollow, generally tubular enclosure 12 has a solid gas-impermeable sidewall which defines an interior lumen or waveguide volume extending from an open top end 14 which is in continuous fluid communication with open bottom end 18 to define an enclosed lumen or waveguide volume therebetween, and this volume is configured to function as part of an acoustically resonant structure, tuned as described below.

Preferably, the woofer mounting angle θ (between the ceiling plane 22 and the driver-mount plane 36) is selected to be between 20 and 80 degrees, and in the illustrated embodiment of FIG. 4 is 40 degrees to provide an oval-shaped opening 32 which will correspond to the oval shape and size of a "four by six" oval woofer 16 that is to be mounted to and carried upon the distal or upper rim 34 of enclosure 12, which permits use of a substantially circular ceiling opening (or "cutout") of approximately four and one half inches in diameter.

The upper end 14 of the enclosure incorporates an upstanding ring 90, the top edge of which forms the rim 34 onto which the acoustic driver 16 is mounted. A plurality speaker mounts 92 are located around the periphery of the ring. The illustrated loudspeaker driver 16 is an oval electro-dynamic woofer of conventional design, having a major diameter 94, which matches the major diameter 96 (FIG. 4) of the oval rim 34, and a perpendicular minor diameter which matches the minor diameter of the rim 34, which dimension is substantially the same as the diameter of the circular bottom opening of the enclosure, and thus of the face plate 52. The driver is selected to provide desired audio output characteristics for the loudspeaker assembly 10 in accordance with the particular application of the assembly, and incorporates a mounting rim 100 for engaging the top edge of oval rim 34 when the driver is mounted on the enclosure. A plurality of mounting tabs 102 are spaced around the mounting rim 100 of the driver for use in securing the driver to the enclosure by way of suitable fasteners, such as screws, to corresponding mounts 92.

As illustrated, the dimensions of the driver 16, as mounted on the enclosure, when projected onto the plane 22, also fit within the diameter of the face plate 52 and the opening 48. The maximum dimension of the entire speaker assembly 10 as projected on the plane 22 may be referred to as the "footprint" of the assembly, and it will be understood from the foregoing that this footprint is smaller than the ceiling or plenum opening 48 to allow easy mounting of the assembly through opening 48 even though the maximum diameter 94 of the oval driver 16 is greater than the diameter of opening 48. When installing the loudspeaker, the speaker assembly 10, including the enclosure 12, the acoustic driver 20, and the speaker module 20 are inserted through the hole 48 in a ceiling structure 50 such as a ceiling tile, and the L-shaped fasteners 46 are rotated so the speaker assembly is adjusted in the aperture 48 so the trim flange 70 will firmly secure the assembly.

Figure 2:
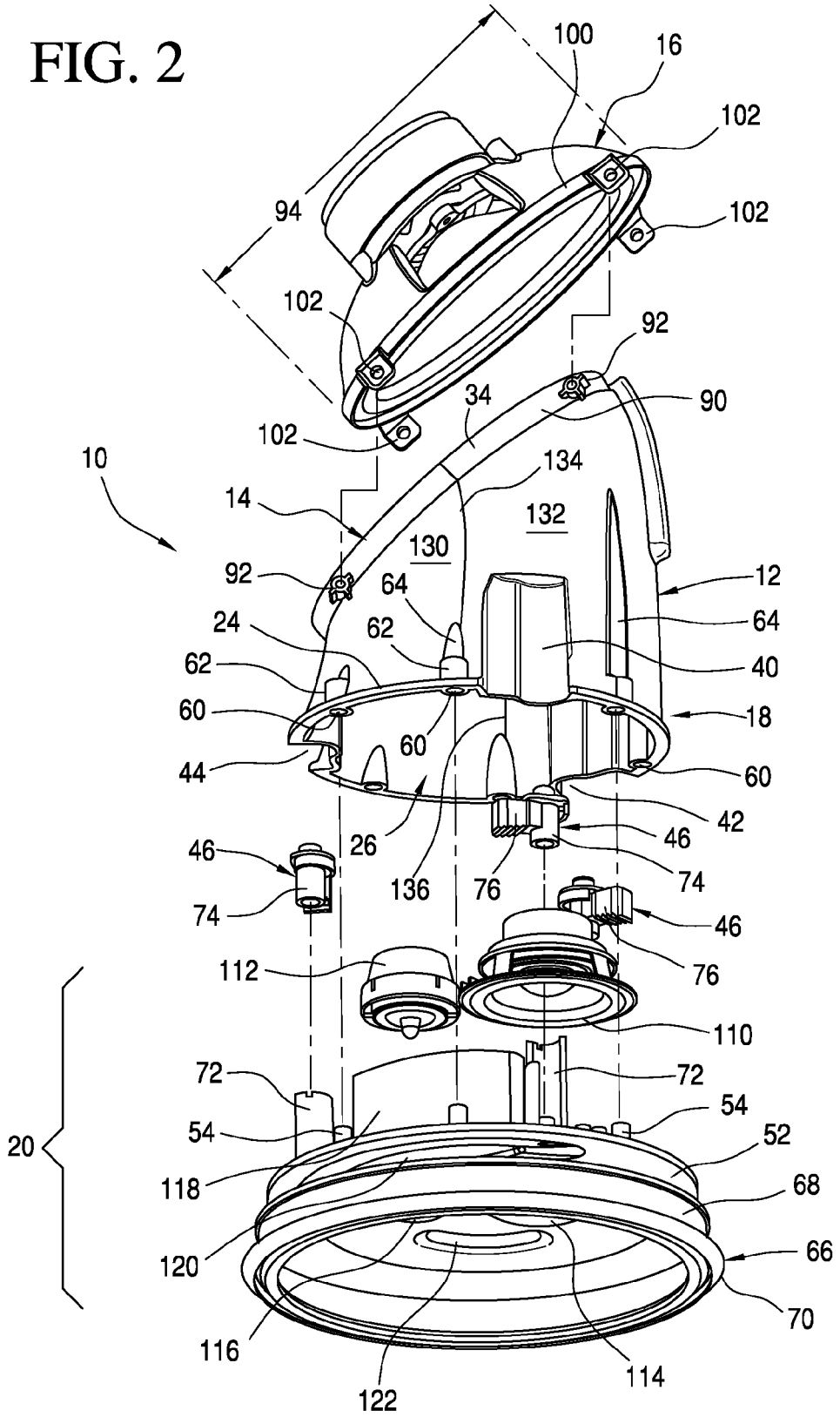
FIG. 2 is an exploded view of the ceiling loudspeaker assembly of FIG. 1.
Figure 3:
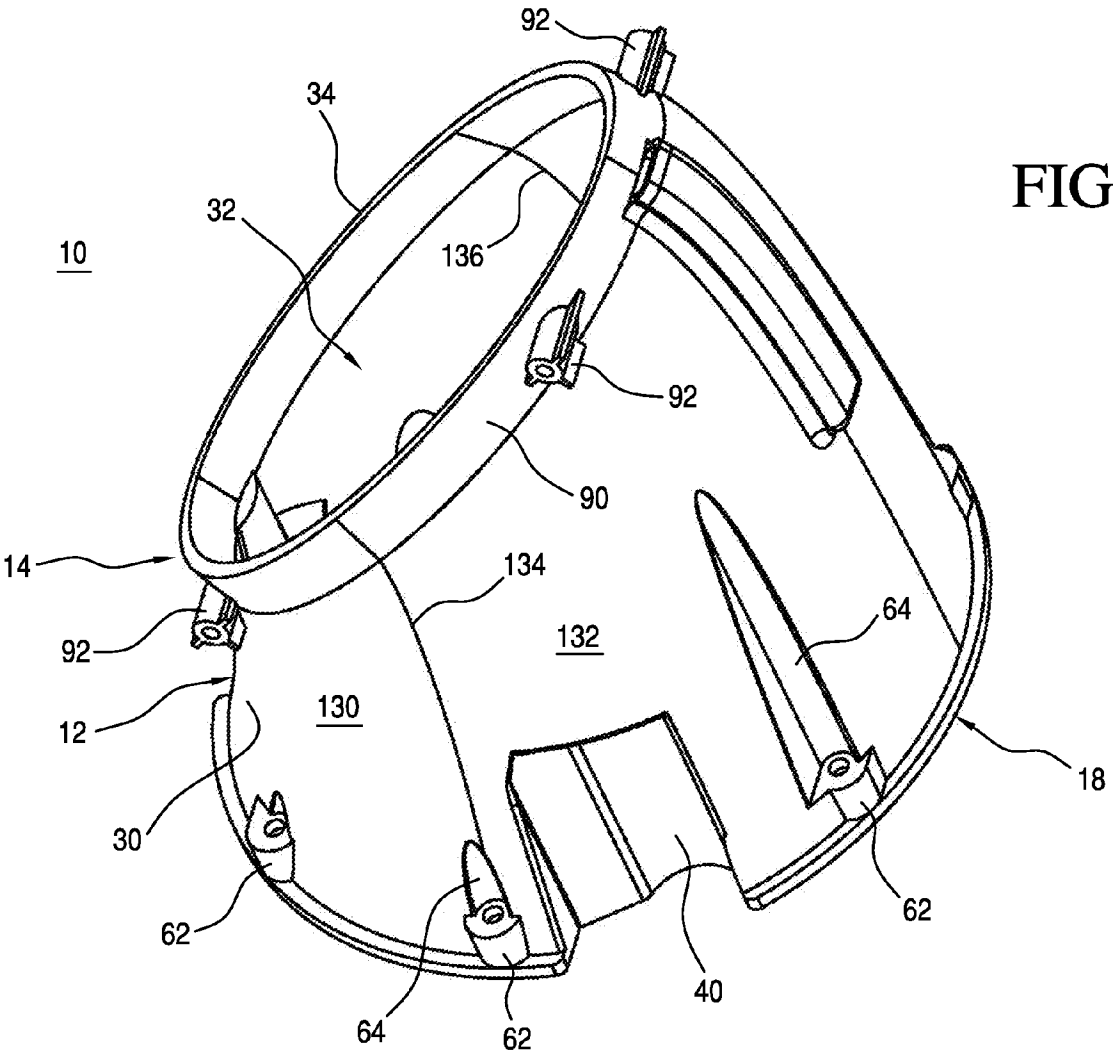
FIG. 3 is a top perspective view of the horn enclosure used in the speaker assembly of FIG. 1.

The speaker module 20, as illustrated in the exploded view of FIG. 2, incorporates a midrange driver 110 and a tweeter driver 112 mounted on the top surface of the front plate 52 over corresponding openings 114 and 116 for producing output sounds in different frequency ranges. A housing, or midrange cup 118, may also be mounted on plate 52 to surround and isolate the midrange driver 110.

The use of the face plate 52 allows the drivers 110 and 112 to be mounted side-by-side, providing a baffle and eliminating the need for a conventional bridge-type coaxial mounting for the tweeter 112. In addition, suitable ports, such as ports 120 and 122, are provided in the front plate 52. These cooperate with the enclosure 12 to provide an acoustic ported enclosure for the driver 16. Ports 120 and 122 are preferably configured as inwardly projecting tubes having solid sidewalls which terminate at inward open ends in fluid communication with the enclosure's interior lumen and the effective cross sectional area and length of the ports 120, 122 are chosen to "tune" the speaker system's Helmholtz resonant frequency. A Helmholtz resonator, as known to those skilled in the art, consists of an acoustic mass and an acoustic compliance tuned to resonate at a selected frequency. More generally, a Helmholtz resonator is a closed volume of air communicating with the outside through one or more pipes. The enclosed air resonates at a specific frequency that depends on the volume of the containing enclosure as well as the dimensions of the pipe(s) being used. Helmholtz resonators used for loudspeaker enclosures are usually in the form of a rectangular box with a pipe located in a circular opening whose diameter is typically smaller than that of the loudspeaker. Helmholtz resonators can be thought of as analogous to an object with a certain mass connected to a spring. The air enclosed in the enclosure's interior (acting as a kind of cushion) provides the stiffness of the system, thus acting as a spring, and the air enclosed in the pipe(s) acts as a mass. Together, this produces a resonator of a specific frequency. If a speaker is mounted in such a resonator, carefully tuned to its specifications, a straight frequency response into deep bass can be achieved. This is because around the natural frequency of the Helmholtz resonator, the vibrating air exiting from the pipe produces most of the acoustic pressure. At the same time, the excursions of the speaker cone are limited because of back pressure from the inside of the Helmholtz resonator; the phase of the back pressure in the Helmholtz resonator is opposite to that of the speaker. The result is better bass at higher acoustic pressure levels than would be possible otherwise.

Figure 5:
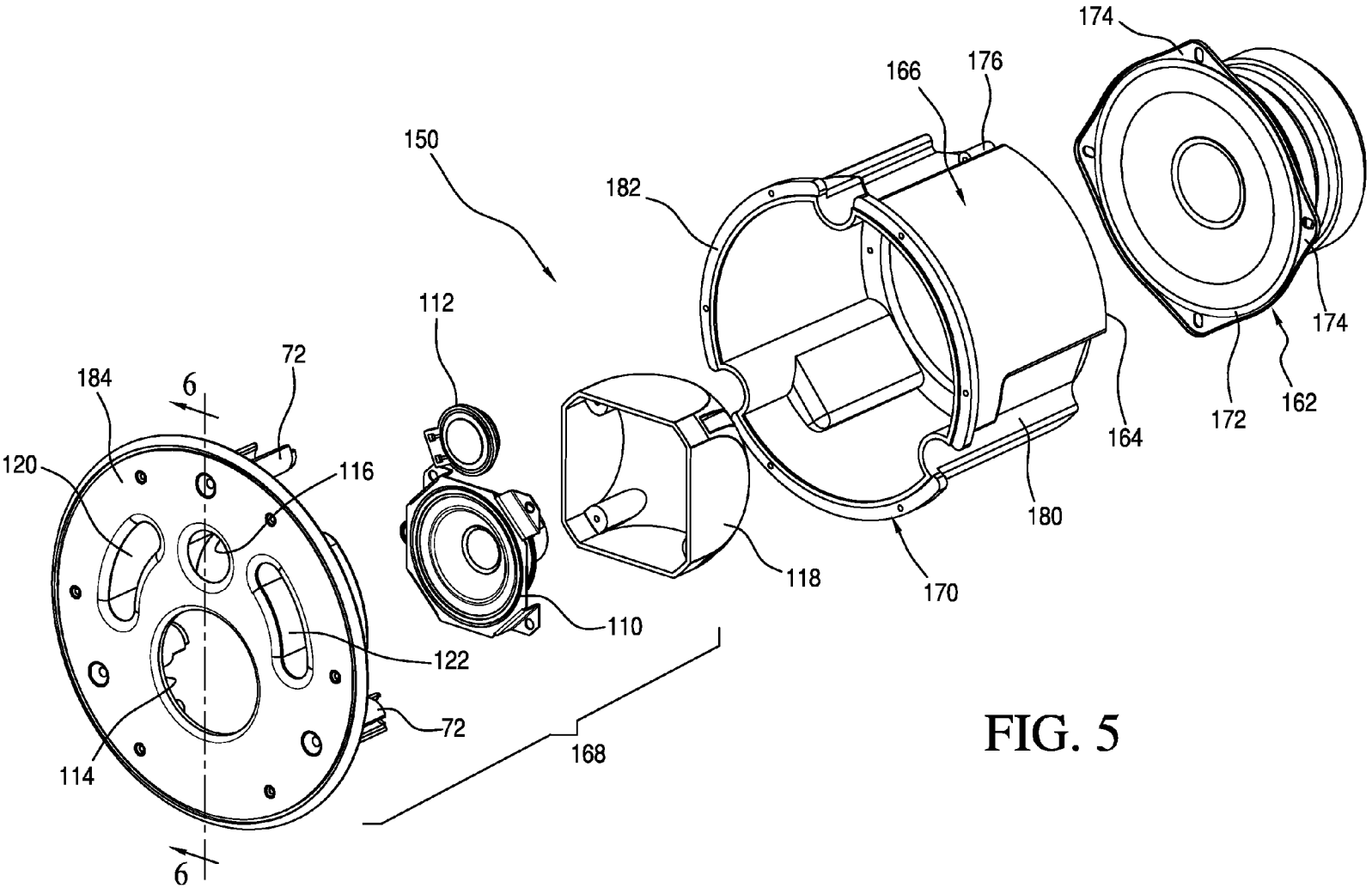
FIG. 5 is an exploded view of a second embodiment of the present invention, illustrating a speaker assembly having a cylindrical horn enclosure, a non-slanted woofer at a top end, and a speaker module incorporating a midrange driver and a tweeter mounted on a ported baffle plate at a bottom end.

Ports 120 and 122 terminate in openings having a selected cross sectional area and shape which are sufficiently large to minimize audible turbulence. More specifically, Port 120 terminates in a first arc-shaped opening shown in the upper left portion of baffle plate 52 (in FIGS. 2 and 5) and port 122 terminates in a second arc shaped opening in baffle plate 52. The port openings define arc-shaped or curved annular segments having semi-circular ends and radiussed edges and are aligned along a circular or arcuate line to provide radiussed outer edges which are aligned along an arc that is substantially concentric with the center of baffle plate 52 (as best seen in FIG. 5). This port opening configuration occupies space near the baffle's edge and so provides ample room near the center of the baffle surface for the midrange and tweeter mounting locations.

When the assembly is complete, the oval acoustic driver 16 is fixed to, and is immediately adjacent to, the oval top opening 32 of the enclosure 12 in a close-coupled arrangement, with the dimensions of the face of the acoustic driver 20 corresponding to the dimensions of the top opening. Additionally, the speaker module 20 is firmly mounted to the circular bottom opening 26 of the enclosure 12, opposite to the top opening 32 to for a horn-shaped speaker system.

Although the area of the top oval opening 32 exceeds the area of the bottom circular opening 26, the projected dimensions of the top opening 32 on the plane 22, (or "footprint") as described above, will be substantially the same as the dimensions of the bottom opening 26, due to the slanted configuration of the top opening, thereby facilitating easy entrance of the acoustic driver 16 and the horn enclosure 12 through the small hole 48 for installation. This configuration allows the acoustic driver 16 to have larger dimensions than the diameter of the hole 48, thus allowing a higher power-handling level than would normally be possible with a speaker opening of the dimensions of the hole 48, thereby facilitating powerful, highly efficient output from a relatively small ceiling opening.

As illustrated in FIGS. 1-4, the horn-shaped enclosure 12 has a tapered, or bent, structure which may be made by joining two semi-cylindrical (or for a given transverse reference plane, semi-circular) injection molded resin bodies 130 and 132 to each other along interface joints 134 and 136 on opposite sides of the enclosure. The two resin bodies 130 and 132 define the bottom and top openings 26 and 32 of the horn enclosure 12.

As noted above, tubular enclosure 12 defines an interior lumen or waveguide volume extending from top opening 26 to bottom opening 32 to define an enclosed lumen or waveguide volume therebetween, and this volume, and the tuning of ports 120 and 122 in the front plate 52, when assembled to the woofer driver 16, define a tunable Helmholtz-type resonator. In conjunction with the volume of air behind the woofer in the ceiling space 140 (FIG. 1), they make up a band-pass type alignment. Tuning of this Helmholtz resonator affects the woofer's response, and since the speaker assembly is a closed system, it affects the midrange unit 110 as well.

In the ceiling speaker assembly 10 of the present invention, the inwardly projecting ports 120 and 122 are dimensioned (i.e., tuned) to be as low in frequency as possible (e.g., ~300 Hz) so that the ports do not resonate within the pass-band of the higher frequency output of the midrange unit 110. By tuning the ports to have a frequency range that is essentially below the critical frequency range of the midrange 110, the enclosure of the present invention elegantly and economically obviates any need for additional crossover components, such as a notch filter, which would add cost and possibly degrade sonic performance. The net result is a speaker assembly with superior performance, when compared to a traditional in-ceiling speaker of equivalent frontal area or baffle size.

For purposes of nomenclature, enclosure 12 is described as tubular and shown as conical or cylindrical horn-like structure having a substantially solid and gas impermeable sidewall terminating at a top, upper or distal end 14 in an opening configured to engage and carry a distal driver (e.g., woofer 16) and terminating at the ceiling, lower or proximal end 18 in an opening configured to receive baffle 52 proximate the mounting apparatus configured to releasably engage a ceiling structure or plenum barrier. Tube-like and Tubular, as used herein, need not be conical, cylindrical or circular in cross section, as will be appreciated by those of skill in the art, and so can also comprise any tube, duct, waveguide or conduit-like structure having impermeable side wall(s) which enclose an interior volume and lumen between the distal driver and the proximal baffle, and so, for example, could be used with a square or rectangular woofer mounted distally upon a box-shaped enclosure (with four side walls) terminating proximally in a square baffle opening.

The advantages of the speaker module 20 described above and illustrated in FIG. 2 can also be attained in a speaker assembly that does not utilize a slanted, oval-shaped woofer driver, but instead uses a circular woofer in the manner illustrated in FIGS. 5-7, to which reference is now made. As there illustrated, a modified speaker assembly 150 incorporates an acoustic driver 162 secured to the top end 164 of a generally cylindrical enclosure 166, and a speaker module 168 secured to the lower end 170 of the enclosure. In this embodiment, the woofer/driver 162 has a generally circular face 172 which engages the top 164 of the enclosure and is secured thereto by suitable fasteners (not shown) which pass through flanges 174 on the driver to engage corresponding bosses 176 on the enclosure, and the diameter of the driver 163 is substantially the same as the diameter of the enclosure 166.

The enclosure 166 is not tapered in the embodiment of FIGS. 5-7, nor does it have a slanted top edge, but otherwise it is substantially the same as the enclosure 12, incorporating recesses 180 for receiving suitable ceiling fasteners, such as the fasteners 46 illustrated in FIG. 2, and having a bottom flange 182 for use in securing it to a baffle plate 184 forming the bottom face of the speaker module 168

The baffle plate 184 preferably is substantially the same as the plate 52 illustrated in FIG. 2, incorporating the ports 120 and 122 described above, and carrying the midrange driver 110 and the tweeter 112, mounted over corresponding apertures 114 and 116. A cup 118 covers and isolates the midrange driver 110, also as described above. As illustrated in the embodiments of both FIG. 2 and FIG. 5, the speaker configuration provided by the present invention positions the woofer 16 (or 162) at the back of the tubular enclosure 12 (or 166) and transmitting its output sound through ports in the front baffle plate 52 (or 184) into a listening area in front of the speaker assembly. The plate 52 (or 184) serves as a baffle for both the midrange driver 110 and the tweeter 112, and since the ports take up only a portion of the surface of the baffle, the tweeter and the midrange driver suffer much less from diffraction and reflection than is the case with prior coaxial tweeter/midrange combinations, so that dispersion in the midrange and high frequencies is improved.

Since the baffle plate 52 (or 184) is mounted to be flush with the lower surface 80 of the ceiling, as illustrated in FIG. 1, the described arrangement of the woofer, midrange and tweeter loudspeakers provides a full range sound not only directly in front of the speaker assembly, but provides improved sound to the sides of the assembly for a more even distribution of sound. If desired, however, the baffle plate can be tilted with respect to the surface of the ceiling (or other mounting surface) to prove a more directional sound for applications such as home theaters or the like.

For purposes of nomenclature, enclosure 166 is described as tubular or tube-like and shown as a right-circular cylindrical structure having a solid, gas impermeable sidewall terminating at a top, upper or distal end 164 with an opening configured to engage and carry a distal driver (e.g., woofer 162) and terminating at the ceiling, lower or proximal end (e.g., 170) in an opening configured to receive a baffle 184 proximate the mounting apparatus configured to releasably engage a ceiling structure or plenum barrier. The descriptive terms Tube and Tubular, as used herein, need not be strictly cylindrical or circular in cross section, as will be appreciated by those of skill in the art, and so can also comprise any tube-like structure with impermeable side walls which enclose an interior lumen between the distal driver and the proximal baffle, and so, for example, could be used in with a square or rectangular woofer mounted distally upon a box-shaped enclosure (with four side walls) terminating proximally in a square or rectangular baffle opening.

The ceiling loudspeaker system of the present invention thus includes a tubular enclosure (i.e., 12 or 166) with an interior lumen that is in fluid communication with first and second inwardly projecting tubular acoustic ports and the tubular enclosure's interior lumen, first port and said second port are dimensioned to provide a Helmholtz resonator tuned port loudspeaker system adapted to project low-pass limited acoustic waves from the woofer or first driver, and the tuned port loudspeaker system is tuned to provide selected port resonant frequency (e.g., 300 Hz). The midrange driver (110) or second higher frequency acoustic driver is configured to radiate over a natural pass-band frequency range that is above the selected port's resonant frequency.

Baffle plate 52 is configured for use with either the embodiment of FIG. 2 or the embodiment of FIG. 5, so, as above, ports 120 and 122 terminate in openings having a selected cross sectional area and shape which are sufficiently large to minimize audible turbulence. More specifically, port 120 terminates in a first arc-shaped opening shown in the tipper left portion of baffle plate 52 (in FIG. 5) and port 122 terminates in a second arc shaped opening in baffle plate 52. The port openings define arc-shaped or curved annular segments having semi-circular ends and radiussed edges and are aligned along a circular or arcuate line to provide radiussed outer edges which are aligned along an arc that is substantially concentric with the center of baffle plate 52 (as best seen in FIG. 5). This port opening configuration occupies space near the baffle's edge and so provides ample room near the center of the baffle surface for the midrange and tweeter mounting locations.

While the invention has been described by way of example and in terms of preferred embodiments, it is to be understood that the invention is not limited thereto; to the contrary, it is intended to cover various modifications and similar arrangements as would be apparent to those skilled in the art. Therefore, the scope of the appended claims should be accorded the broadest interpretation to encompass all such modifications and similar arrangements.

What is claimed is:

1. A loudspeaker assembly, comprising:

(a) a tubular enclosure comprising a first opening substantially parallel to a first plane and communicating through an interior lumen with a second opening substantially parallel to a second plane, said tubular enclosure having a solid gas-impermeable sidewall between said first opening and said second opening; wherein the first plane is inclined with respect to the second plane at an acute angle;

(b) an acoustic driver connected to the first opening for transmitting an acoustic output sound through the tubular enclosure's interior lumen to the second opening;

(c) said tubular enclosure having a speaker module connected to the second opening; wherein the tubular enclosure first opening is a top opening which is substantially parallel to the first plane and said second opening is a bottom opening which is substantially parallel to the second plane; wherein the acoustic driver is secured in the top opening;

(d) wherein the speaker module is secured in the bottom opening of the tubular enclosure, and wherein the area of the first opening exceeds that of the second opening;

(e) wherein the top opening is substantially oval in shape;

(f) wherein the bottom opening is substantially circular in shape;

(g) wherein said acoustic driver connected to said first opening comprises a first low frequency acoustic driver secured in the top opening of the tubular enclosure; and said speaker module secured in the bottom opening of the tubular enclosure has a baffle plate extending across said bottom opening and carrying at least first and second acoustic ports in said baffle plate for transmitting acoustic waves from said first driver out of said enclosure;

(h) wherein said speaker module includes at least a second higher frequency acoustic driver mounted over a corresponding opening in said baffle plate for directing acoustic waves from said second driver downwardly and away from said baffle plate;

(i) wherein said tubular enclosure's interior lumen is in fluid communication with said first and second acoustic ports; and wherein said tubular enclosure's interior lumen, said first port and said second port are dimensioned to provide a tuned port loudspeaker system adapted to project low-pass limited acoustic waves from said first driver, wherein said tuned port loudspeaker system is tuned to provide selected port resonant frequency; and (j) wherein said second higher frequency acoustic driver is configured to radiate over a natural pass-band frequency range, and said selected port resonant frequency being below the natural pass-band frequency range of said second, higher frequency driver.

2. The loudspeaker assembly of claim 1, wherein the tubular enclosure is horn shaped and has a bent structure.

3. The loudspeaker assembly of claim 1, wherein the projection area of the first opening onto the second plane is smaller than the second opening.

4. The loudspeaker assembly of claim 1, further including:

a fastener for securing the assembly in an aperture in a ceiling structure; and a trim ring incorporating a flange engaging said speaker module and cooperating with said fastener to mount the assembly in a ceiling.

5. The loudspeaker assembly of claim 4, wherein the tubular enclosure further comprises a recess for receiving said fastener.

6. The loudspeaker assembly of claim 1, wherein the tubular enclosure further comprises first and second resin semicylindrical bodies each semicylindrical body defining a solid gas-impermeable sidewall, wherein said first and second semicylindrical bodies are joined to each other to form the tubular enclosure, and to define the first and second openings.

7. The loudspeaker assembly of claim 6, wherein said first and second semicylindrical resin bodies are injection molded.

* * * * *